US005287565A

United States Patent [19]

Auman et al.

[11] Patent Number: 5,287,565

[45] Date of Patent: Feb. 22, 1994

[54] WATER SAVING DISPENSING DEVICE

[75] Inventors: C. David Auman; Jack L. Martin, both of Belleville, Ill.

[73] Assignee: Aqua Smart, Inc., Belleville, Ill.

[21] Appl. No.: 990,652

[22] Filed: Dec. 14, 1992

Related U.S. Application Data

[63] Continuation-in-part of Ser. No. 624,599, Dec. 10, 1990, abandoned, and a continuation-in-part of Ser. No. 824,997, Jan. 27, 1992, abandoned.

[51] Int. Cl.[5] ..... E03D 1/00

[52] U.S. Cl. ..... 4/415; 137/561 A

[58] Field of Search ..... 4/415; 137/441, 561 A

[56] References Cited

U.S. PATENT DOCUMENTS

| | | | |
|---|---|---|---|
| 2,777,460 | 1/1957 | Svirsky | 137/218 |
| 2,807,024 | 9/1957 | Kapp | 137/441 X |
| 3,086,217 | 4/1963 | Barlow | 4/367 |
| 3,864,938 | 2/1975 | Hayes, Jr. | 62/504 |
| 4,122,862 | 10/1978 | Brandelli | 137/437 |
| 4,145,775 | 3/1979 | Butler | 4/415 |
| 4,230,569 | 10/1980 | Lohrberg et al. | 210/754 |
| 4,302,338 | 11/1981 | Pfohl | 210/752 |
| 4,512,368 | 4/1985 | Kaminaka et al. | 137/561 A |
| 4,712,578 | 12/1987 | White | 137/271 |
| 4,759,382 | 7/1988 | Harel | 137/564 |
| 4,764,996 | 8/1988 | Pino | 4/415 |
| 4,781,309 | 11/1988 | Vogel | 222/129.1 |
| 4,980,932 | 1/1991 | Stemples | 4/415 |

FOREIGN PATENT DOCUMENTS

| | | | |
|---|---|---|---|
| 217654 | 6/1957 | Australia | 137/561 A |

*Primary Examiner*—Robert M. Fetsuga

*Attorney, Agent, or Firm*—Senninger, Powers, Leavitt & Roedel

[57] ABSTRACT

A simple yet inexpensive device is presented which is used to divide the water normally supplied to the spill tube and gooseneck reservoir of a commode. Dividing the water supplied to the spill tube and diverting a substantial portion of that water to a holding tank of a commode saves water that is normally unnecessarily fed directly down the drain in the refilling process. The device is a small plastic insert that has a generally rectangular main body. At one end of this main body is a horizontal inlet tube. At the bottom of the main body are a number of lower vertical outlet tubes. In order to evenly disperse the inlet water among the vertical outlet tubes, the upper mouth of the vertical outlet tubes is constricted by narrowing the diameter of the mouth with respect to the inner diameter of the inlet tube. Water is thus distributed evenly among the lower outlet tubes. By changing the number of lower outlet tubes that feed water to the spill tube or holding tank, the correct proportion of water supplied to the gooseneck may be obtained.

20 Claims, 3 Drawing Sheets

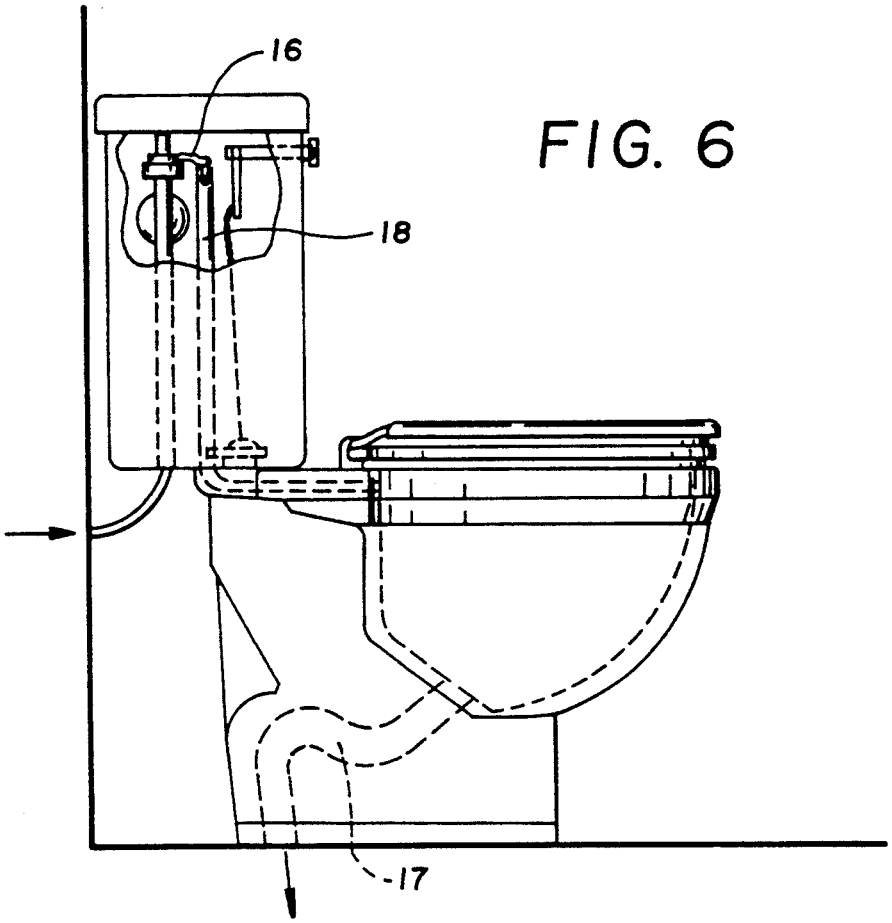
FIG. 6
FIG. 8
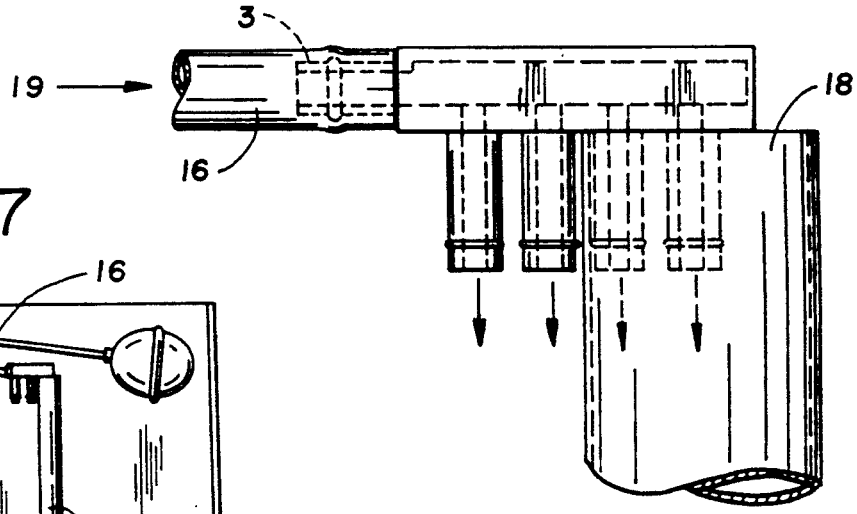
FIG. 7
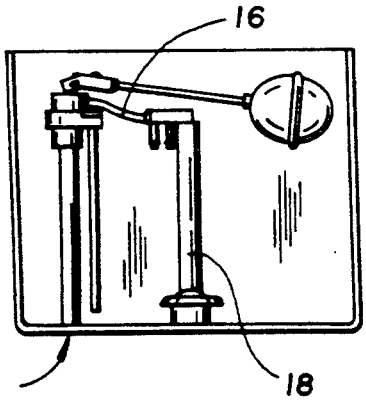

WATER SAVING DISPENSING DEVICE

BACKGROUND OF THE INVENTION

This invention is a continuation-in-part of prior U.S. application Ser. No. 624,599 filed Dec. 10, 1990, and Ser. No. 824,997 filed Jan. 27, 1992, both abandoned.

This invention relates to the field of plumbing and more particularly to the use of water in a standard commode. The device in particular relates to the use of water in filling the tank and gooseneck reservoir of the plumbing fixture. This device is used with all water closets having a holding tank and gooseneck reservoir which are filled by splitting the main source water between the holding tank and gooseneck reservoir. The device would have particular applicability in homes, commercial restrooms, office buildings or other areas where toilet facilities are provided.

This invention relates to the holding tank of a commode and more particularly to a water saving device which divides the water inlet supply to the spill tube into several outlets and allows the user of the device to distribute water in a more efficient fashion.

Years ago when residential and commercial commodes were designed, little care was taken with regard to the amount of water needed to perform the various functions. In operation of a commode, water is fed into a holding tank and water trap by a single supply line and is flushed through the device by a flushing handle. Once the water has been released from the holding tank, it will automatically refill. The water in the holding tank is used for the next flush. At the same time, water is directed down the spill tube to fill up a water seal trap at the bottom of the commode.

Most commodes use a single water supply line to refill the holding tank and water trap. Water is fed into the holding tank through a main water supply tube. This single water supply line not only fills up the holding tank but also is split and supplied to the spill tube through a usually flexible second supply tube. The spill tube feeds water below the level of the holding tank into the water trap or gooseneck. The gooseneck has a small reservoir of water on the lower curve thus creating the water trap. The water used in the plumbing device, when the holding tank is flushed, overflows the gooseneck and runs down the drain pipe thus facilitating the flushing procedure. However, the volume of water necessary to fill the gooseneck is much smaller than the volume of water necessary to fill the holding tank.

Currently, the water which is fed into the holding tank is divided between water which is put in the holding tan initially and a second line which is fed into the spill tube, then to the gooseneck below the holding tank, filling the water trap. Since much more water is required to fill the holding tank than to fill the small reservoir at the bottom of the gooseneck, a very inefficient plumbing fixture is currently in use.

While the holding tank is being filled, the water in the gooseneck quickly accumulates above the level necessary for the water trap. Excess water then runs down the drain and is completely wasted. The water which is in excess of that necessary to fill the gooseneck reservoir and which runs down the drain while the upper holding tank is being filled, is water that can be conserved by the instant device.

While a number of complicated and expensive devices have been manufactured to adapt the flushing tank system to save water, these inventions are cumbersome to install and frequently fail in service. Several of these inventions direct themselves to restricting the water supplied to the spill tube, while others split the two lines and insert valves in each line to independently control each water supply. No device has been disclosed which uses the normal singular supply water tube at the normal pressure and which diverts the water according to the necessary volume required.

It is an object of this invention to provide a simple device which may be quickly and simply attached to the end of the flexible second water supply tube to divert water from the spill tube to the holding tank itself.

It is a further object of this invention to provide a simple and easily installed device to save water. It is a still further object of this invention to provide a one-piece, lightweight, inexpensive insert for the second water supply tube which enables the user of the device to apportion the water supplied to the gooseneck water trap or the holding tank according to the individual requirements of the specific fixture being used. For example, if it is desired that half of the water normally supplied to the gooseneck be fed or supplied to the gooseneck reservoir (with the other half to the holding tank), then the third and fourth outlet tubes of four total would be placed inside the spill tube to supply water to the gooseneck. However, as is the most common case, the water volume normally supplied to the gooseneck reservoir is much more water than normally needed to fill the gooseneck. In that instance, only the fourth outlet tube would be placed over the spill tube feeding the gooseneck, and thus the ratio of water in the water reservoir to water supplied to the holding tank would be 1:7.

BRIEF SUMMARY OF THE INVENTION

Generally, a flush closet includes a toilet bowl and a toilet tank for supplying flush water to the bowl. The tank has a main conduit for supplying water from a water supply source to the tank and bowl after each flush. The main conduit feeds a first supply line for supplying the tank with water after a flush and a second supply line for supplying the toilet bowl with water after a flush. The second supply line dispenses water into a spill tube in fluid communication with the bowl. The improvement of this invention comprises a water saving device for dividing the flow of water from the second supply between the spill tube and the tank. The device comprises an elongate manifold having an inlet connected to the end of the second supply line. An elongate chamber is in fluid communication with the inlet for receiving water from the inlet, and a plurality of outlet ports are arranged in a row extending generally lengthwise of the manifold and spaced at intervals along the length of the manifold in fluid communication with the chamber. The manifold has a plurality of outlet tubes extending laterally from the manifold at spaced intervals, one for each port of the manifold, along the length of the manifold. The outlet tubes have spaces therebetween with each space having a width greater than the thickness of the wall of the spill tube for interfitting of the device with the upper end of the spill tube. The outlet tubes have means on the outside thereof for frictionally gripping the wall of the spill tube for holding the device in a generally secure position with respect to the spill tube. The device, as applied to the upper end of the spill tube, has at least one of the outlet tubes extending down into the upper end of the spill tube with the wall of the spill tube extending into the space between said at least one outlet tube and an adjacent one of the outlet tubes and being engaged by the engagement means. The outlet tubes deliver a portion of the water from the second supply line into the spill tube and deliver the remainder into the tank.

BRIEF DESCRIPTION OF THE DRAWINGS

FIG. 6 is a view of the general layout of a bathroom fixture having a tank, bowl and gooseneck reservoir.

FIG. 7 is a detail view of FIG. 6 showing the second flexible tube and spill tube, with the instant device in place.

FIG. 8 is an enlarged detail view of the alternate embodiment of the instant device as it is placed over the spill tube.

DETAILED DESCRIPTION OF THE PREFERRED EMBODIMENT

Water is supplied to the holding tank and gooseneck of a commode by means of a main water supply tube 19. This water normally is divided between the gooseneck reservoir and the holding tank, with one portion of the water fed directly into the holding tank while the remaining amount of the water is fed through a second flexible supply tube into a cylindrical spill tube. This cylindrical spill tube feeds water down through the bottom portion of the plumbing device and into a gooseneck.

The instant invention herein is a simple means for dividing the water from the second flexible supply tube so that part of the spill tube water flows into the cylindrical spill tube from the second supply tube while the remaining portion of the water supplied by the second flexible supply tube is fed into the holding tank. The holding tank thus fills up more quickly than under the current normal devices and much water is saved.

Figure 3:
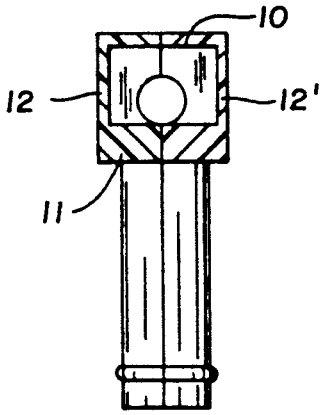
FIG. 3 is an end cutaway view of the device taken along lines 3—3 of FIG. 1.
Figure 4:
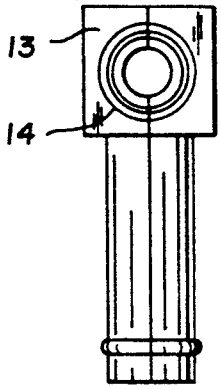
FIG. 4 is a left end view of the device.
Figure 5:
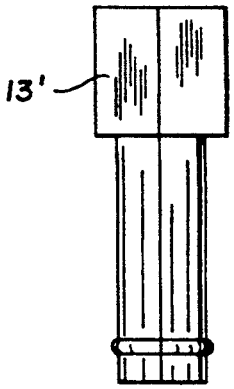
FIG. 5 is a right end view of the device.

The device herein comprises an essentially rectangular main body 1. This rectangular main body 1 is hollow and has a plenum chamber 9 as its central portion. The main body 1 has an essentially square cross-section as shown in FIG. 3. This main body has a top 10, a bottom 11, vertical sides and 12 and 12', and vertical ends 13 and 13'.

Attached to one end 13 of the main body 1 is a horizontal water supply inlet tube 2. The flexible water supply tube 16 which is normally used to supply water to the gooseneck reservoir 17 by way of the spill tube 18, is attached to the outer end 3 of the inlet tube 2.

Figure 1:
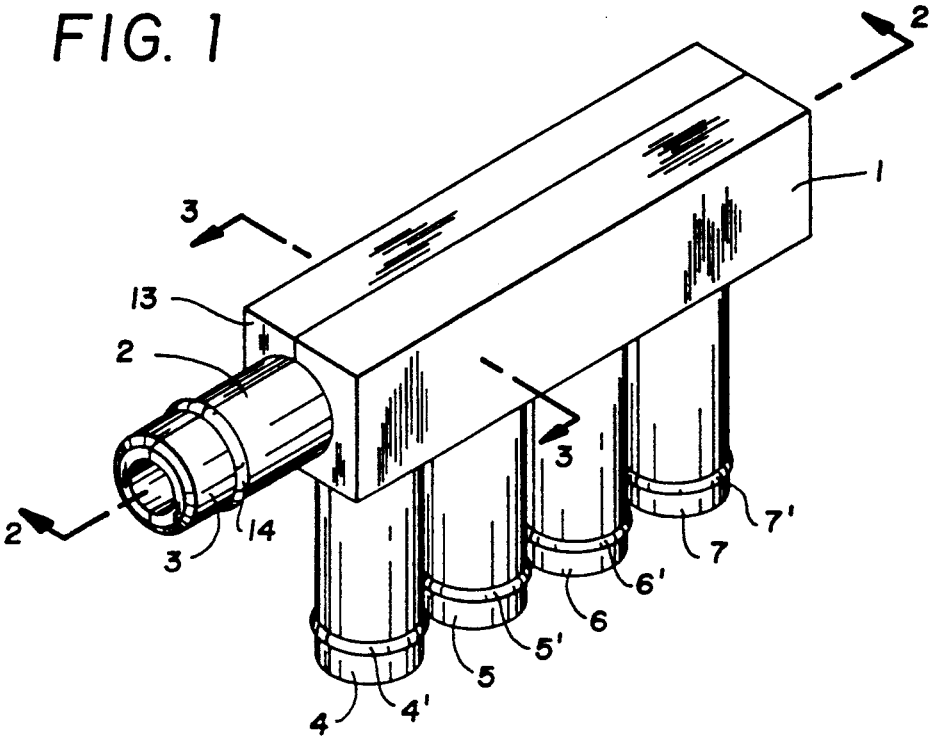
FIG. 1 is a perspective view of the device.
Figure 2:
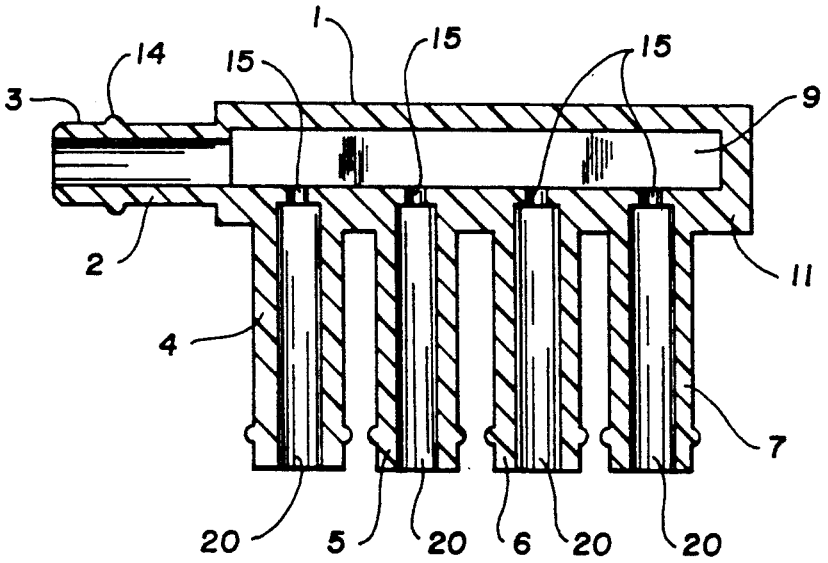
FIG. 2 is a side cut away view of the device taken along lines 2—2 of FIG. 1.

This inlet tube 2 is best shown on FIGS. 1, 2 and 8.

Figure 9:
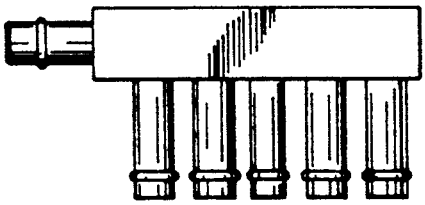
FIG. 9 is an alternate five-pronged embodiment of the device.
Figure 10:
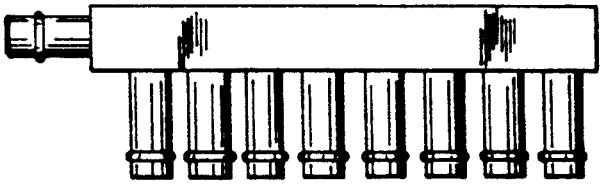
FIG. 10 is an alternate eight-pronged embodiment of the device.

Attached to the bottom 11 of the main body 1 are a plurality of lower tubes 4, 5, 6 and 7. These lower tubes as shown on Drawing FIGS. 1 and 2 may be four in number. However, any number of lower tubes could be used while still within the spirit and conception of the instant invention, as shown in FIGS. 9 and 10. At least two outlet tubes are required to split the water.

The lower tubes 4 through 7 are used to divide the water supplied by the flexible water tube 16. When the flexible supply tube 16, which is normally attached directly to the inside of the spill tube, is attached to the outer end 3 of the inlet tube 2, as shown in FIG. 8, the water supplied normally to the spill tube is first directed to the hollow plenum chamber 9 of the main body 1. This water, thus supplied, is then discharged through the first lower tube 4, the second lower tube 5, the third lower tube 6 and the fourth lower tube 7.

In the operation of the instant device certain problems have been encountered due to the fluctuating pressure of the inlet water and variations between plumbing fixtures. The main water source 19 to the entire plumbing fixture is introduced into the fixture as best shown in FIG. 6. Sometimes the pressure of the inlet water 19 is high, but in some applications, in varying parts of the United States or in varying countries, the water pressure is low. Varying water pressure, as well as varying configurations of the plumbing fixtures themselves, can result in an uneven distribution of outlet water through the outlet tubes 4–7. In order to adapt the instant device to all variations, it has been found that constricting the upper openings 15 of the lower outlet tubes 4–7 is a solution. The constrictions, as shown, have been found to be optimum when the constriction opening is approximately one-half the inner diameter of the vertical outlet tube.

As best shown on FIG. 2, the lower outlet tubes 4, 5, 6 and 7 are fluidly connected to the plenum chamber 9 (and hence the inlet tube 2) by connecting the lower tubes to the bottom 11 of the main body 1 of the device. However, each lower vertical outlet tube has its upper mouth 15 narrowed, as shown on FIG. 2. This narrowing of the mouth of the vertical inlet tubes is a pressure regulating means and helps to evenly distribute the water among all outlet tubes so the amount of water discharged from the lower ends 20 of the vertical outlet tubes are similar.

In order to facilitate attachment of the flexible spill tube water supply 16, a tube attaching flange 14 is supplied near the end 3 of the inlet tube 2. Similar flanges are also present near the bottom of the outlet tubes as shown on FIG. 2. However, these lower flanges 4', 5', 6' and 7' are used to secure the lower outlet tubes 4 through 7 to the vertical side of the spill tube 18. These flanges allow the flexible lower tubes to grip the side of the spill tube, so that various wall thicknesses of spill tubes may be accommodated.

The number of lower divider tubes may vary, depending on the precise applications and different plumbing devices used. Since different plumbing devices may have various volumes of water trap reservoirs, the use of this invention allows a different amount of water supplied to the gooseneck reservoir 17 by diverting it from the cylindrical spill tube which feeds the gooseneck directly to the holding tank. This diversion of water can be accomplished by simply changing the number of lower divider tubes which feed the cylindrical spill tube.

For example, if one desired to have half of the water from the flexible water supply tube 16 which feeds the spill tube to be fed into the cylindrical spill tube and hence to the water trap reservoir, half of the lower divider tubes should be placed inside the cylindrical spill tube with the other half of the outlet tubes remaining on the outside of the cylindrical spill tube. This particular mode of using the device is shown on FIGS. 7 and 8.

If the ratio sought to be supplied from the flexible supply tube 16 to the water trap gooseneck reservoir was 1:4 to the holding tank, then one lower outlet tube (the furthest from the inlet tube or the fourth lower tube 7 on Drawing FIGS. 1 and 2) would be inserted within the cylindrical spill tube while the remaining three outlet tubes would supply ¾ of the water normally supplied from the flexible supply tube 16 to the gooseneck water reservoir to the holding tank instead. The holding tank would then be receiving the normal amount of the water supplied to the device plus ¾th of the remaining water from the supply tube 16. This means that a much greater portion of the water supplied to the plumbing device would feed the holding tank while a smaller portion of the water would feed the gooseneck water trap reservoir. Because the volume of the gooseneck water trap reservoir as compared to the volume of the holding tank would be anywhere from 1:3 to 1:7, this device may be used in various applications. A great benefit to the user in terms of lower water bills as well as a benefit to society in terms of less water use per plumbing device is thus gained by use of this simple, inexpensive device.

This device is most simply manufactured of acrylics by simple injection molding in two pieces. The device is normally split along its longitudinal axis, with the lines of split best shown in FIG. 3. The two pieces are molded and then sealed together to form the completed union shown in FIG. 1.

In actual production, the main body 1 is approximately 3.7 cm in length while the square cross-section of the main body is approximately 0.9 cm in length. In the preferred embodiment the inlet tube 2 is approximately 1 cm in length while the lower outlet tubes are approximately 1.5 cm in length. The inside diameter of the vertical outlet tubes is approximately 0.32 cm while the diameter of the opening of the mouth 15 of the vertical outlet tubes would be approximately 0.16 cm. Various lengths and sizes may be used in practicing this invention while keeping within the general spirit and conception of the instant device. The above measurements are meant as an illustration only and not as a limitation on the general concept disclosed herein.

I claim:

1. In a flush closet including a toilet bowl and a toilet tank for supplying flush water to the bowl, the tank having a main conduit for supplying water from a water supply source to the tank and bowl after each flush, the main conduit feeding a first supply line for supplying the tank with water after a flush and a second supply line for supplying the toilet bowl with water after a flush, the second supply line dispensing water into a spill tube in fluid communication with the bowl, the improvement comprising a water saving device for dividing the flow of water from the second supply between the spill tube and the tank, said device comprising an elongate manifold having an inlet connected to the end of the second supply line, an elongate chamber in fluid communication with the inlet for receiving water from the inlet, and a plurality of outlet ports arranged in a row extending generally lengthwise of the manifold and spaced at intervals along the length of the manifold in fluid communication with the chamber, the manifold having a plurality of outlet tubes extending laterally from the manifold at spaced intervals, one for each port of the manifold, along the length of the manifold, said outlet tubes having spaces therebetween with each space having a width greater than the thickness of the wall of the spill tube for interfitting of the device with the upper end of the spill tube, said outlet tubes having means on the outside thereof for frictionally gripping the wall of the spill tube for holding the device in a generally secure position with respect to the spill tube, the device as applied to the upper end of the spill tube having at least one of the outlet tubes extending down into the upper end of the spill tube with the wall of the spill tube extending into the space between said at least one outlet tube and an adjacent one of the outlet tubes and being engaged by said engagement means, said outlet tubes delivering a portion of the water from the second supply line into the spill tube and delivering the remainder into the tank.

2. A device as set forth in claim 1 wherein the manifold includes pressure regulating means for maintaining a generally constant fluid pressure within the chamber.

3. A device as set forth in claim 2 wherein said pressure regulating means comprises, for each port of the manifold, a reduction in the diameter of the port with respect to the diameter of the inlet tube for constricting the amount of water adapted to enter the outlet tube and for creating and maintaining a substantially constant pressure in the chamber, whereby water is adapted to flow into each outlet tube at a substantially constant rate, independent of the location of the outlet tube relative to the inlet.

4. A device as set forth in claim 3 wherein each port has a diameter approximately one-half the diameter of its respective outlet tube.

5. A device as set forth in claim 3 wherein the device is a one-piece molded plastic member.

6. A device as set forth in claim 3 wherein the diameter of each port of the manifold is reduced with respect to the diameter of each outlet tube for each port.

7. A device as set forth in claim 1 wherein the inlet comprises an outwardly extending inlet tube for connecting the second supply line to the device.

8. A device as set forth in claim 1 wherein said engagement means comprises a flange formed on each outlet tube, each of the flanges being spaced an equal distance from the manifold, the flanges of adjacent outlet tubes defining a space therebetween less than the thickness of the wall of the spill tube for gripping the wall of the spill tube and securely connecting the device to the spill tube.

9. A device as set forth in claim 8 wherein each flange extends laterally outwardly from the outer wall of its respective outlet tube.

10. A device as set forth in claim 1 wherein the diameter of each port of the manifold is reduced with respect to the chamber's cross section to evenly distribute the water among the plurality of outlet tubes.

11. A water saving device for use in a flush closet of the type including a toilet bowl and a toilet tank for supplying flush water to the bowl, the tank having a main conduit for supplying water from a water supply source to the tank and bowl after each flush, the main conduit feeding a first supply line for supplying the tank with water after a flush and a second flexible supply line for supplying the toilet bowl with water after a flush, the second supply line dispensing water into a spill tube in fluid communication with the bowl, the device comprising an elongate manifold having an inlet adapted for insertion thereof in the end of the second supply line for relatively sealed interconnection of the second supply line with the manifold, the manifold having an elongate chamber in fluid communication with the inlet for receiving water from the inlet, a plurality of outlet tubes extending laterally from the manifold at spaced intervals along the length of the manifold, said outlet tubes having spaces therebetween for receiving the wall of a spill tube in the tank, said manifold having a series of outlet ports, one for each outlet tube, for flow of water from said chamber into and through the outlet tubes, said outlet tubes having means on the outside thereof for frictionally gripping the wall of the spill tube, whereby the device may be applied to the upper end of the spill tube with at least one of the outlet tubes extending down into the upper end of the spill tube with the wall of the spill tube extending between adjacent outlet tubes and being engaged by said engagement means and with another one of said outlet tubes extending down on the outside of the spill tube for delivering a portion of the water from the second supply line into the spill tube and delivering the remainder into the tank.

12. A device as set forth in claim 11 wherein the manifold includes pressure regulating means for maintaining a generally constant fluid pressure within the chamber.

13. A device as set forth in claim 12 wherein said pressure regulating means comprises, for each port of the manifold, a reduction in the diameter of the port with respect to the diameter of the inlet tube for constricting the amount of water adapted to enter the outlet tube and for creating and maintaining a substantially constant pressure in the chamber, whereby water is adapted to flow into each outlet tube at a substantially constant rate, independent of the location of the outlet tube relative to the inlet.

14. A device as set forth in claim 13 wherein each port has a diameter approximately one-half the diameter of its respective outlet tube.

15. A device as set forth in claim 13 wherein the device is a one-piece molded plastic member.

16. A device as set forth in claim 13 wherein the diameter of each port of the manifold is reduced with respect to the diameter of each outlet tube for each port.

17. A device as set forth in claim 11 wherein the inlet comprises an outwardly extending inlet tube for connecting the second supply line to the device.

18. A device as set forth in claim 11 wherein said engagement means comprises a flange formed on each outlet tube, each of the flanges being spaced an equal distance from the manifold, the flanges of adjacent outlet tubes defining a space therebetween less than the thickness of the wall of the spill tube for gripping the wall of the spill tube and securely connecting the device to the spill tube.

19. A device as set forth in claim 18 wherein each flange extends laterally outwardly from the outer wall of its respective outlet tube.

20. A device as set forth in claim 11 wherein the diameter of each port of the manifold is reduced with respect to the chamber's cross section to evenly distribute the water among the plurality of outlet tubes.

* * * * *